US008075177B2

(12) United States Patent
Kasapi et al.

(10) Patent No.: US 8,075,177 B2
(45) **Date of Patent: *Dec. 13, 2011**

(54) MECHANISM TO AVOID RATE VARIATIONS DUE TO GRAVITATION IN A SPRUNG BALANCE REGULATING ORGAN, AND TIMEPIECE PROVIDED WITH SUCH A MECHANISM

(75) Inventors: Carole Kasapi, La Chaux-de-Fonds (CH); Patrick Pichot, Villers le Lac (FR)

(73) Assignee: Cartier Creation Studio SA, Geneva (CH)

( * ) Notice: Subject to any disclaimer, the term of this patent is extended or adjusted under 35 U.S.C. 154(b) by 0 days.

This patent is subject to a terminal disclaimer.

(21) Appl. No.: 12/905,495

(22) Filed: Oct. 15, 2010

(65) Prior Publication Data

US 2011/0026373 A1 Feb. 3, 2011

Related U.S. Application Data

(63) Continuation of application No. 12/260,193, filed on Oct. 29, 2008, now Pat. No. 7,815,364.

(30) Foreign Application Priority Data

Apr. 30, 2008 (EP) ..... 08008217

(51) Int. Cl.
*G04B 15/00* (2006.01)
*G04B 1/10* (2006.01)

(52) U.S. Cl. ..... 368/127; 368/142

(58) Field of Classification Search ..... 368/127–133, 368/140, 142

See application file for complete search history.

(56) References Cited

U.S. PATENT DOCUMENTS

| | | | | |
|---|---|---|---|---|
| 7,004,619 | B2 | 2/2006 | Papi | |
| 7,160,026 | B2 * | 1/2007 | Golay | 368/127 |
| 7,350,966 | B2 | 4/2008 | Zaugg | |
| 7,445,375 | B2 * | 11/2008 | Kasapi | 368/127 |
| 7,527,423 | B2 * | 5/2009 | Ruchonnet et al. | 368/127 |
| 7,677,793 | B2 | 3/2010 | Lete et al. | |
| 7,946,755 | B2 * | 5/2011 | Greubel et al. | 368/127 |

FOREIGN PATENT DOCUMENTS

WO 2009/026735 3/2009

* cited by examiner

*Primary Examiner* — Sean Kayes
(74) *Attorney, Agent, or Firm* — Young & Thompson

(57) ABSTRACT

The mechanism avoids the rate variations due to the effect of gravitation on a regulating organ of a timepiece whose regulating organ includes a sprung balance and an escape wheel mounted onto a platform. The platform includes a counterweight and is mounted so as to freely rotate about at least a first axis relative to a plate of the movement so that this platform will rotate about the first axis under the effect of terrestrial gravitation. This mechanism includes a wheelwork with a driving kinematical chain linking the escape wheel to a barrel system of the timepiece, and a corrective kinematical chain compensating the movements and speed of the platform relative to the plate, so that these movements of the platform will not perturb the chronometry of the timepiece.

24 Claims, 8 Drawing Sheets

MECHANISM TO AVOID RATE VARIATIONS DUE TO GRAVITATION IN A SPRUNG BALANCE REGULATING ORGAN, AND TIMEPIECE PROVIDED WITH SUCH A MECHANISM

CROSS-REFERENCE TO RELATED APPLICATIONS

This application is a continuation of co-pending application Ser. No. 12/260,193 filed on Oct. 29, 2008, which claims priority to European Application No. 08008217.5 filed on Apr. 30, 2008. The entire contents of each of the above-identified applications are hereby incorporated by reference.

FIELD OF THE INVENTION

The present invention aims at a mechanism avoiding the rate variations due to the effect of gravitation in a sprung balance regulating organ, as well as at a timepiece comprising such a mechanism.

BACKGROUND OF THE INVENTION

Regulating systems called tourbillons are known where the regulating organ, that is, the sprung balance, is mounted into a carriage rotating about one, two, or three orthogonal pivoting axes permanently driven by a clockwork movement, e.g., a third wheel.

It is the main disadvantage of such systems that rotation of said carriage permanently consumes energy even when this is not necessary, e.g., at night with the watch laid down flat and the sprung balance horizontal.

Moreover, the movements of the carriage may theoretically provide a statistical compensation for the rate variations. While the watch is worn at the wrist, though, it undergoes chance movements, and the rate variations cannot be compensated in full by the constant regular movements imposed upon the sprung balance by the rotating carriage.

From the document EP 1 615 085, a seat correction mechanism for a sprung balance regulating mechanism is known that is held horizontally by counterpoise action. The sprung balance is supported by a platform integral with a counterpoise mounted so as to rotate about a first axis, and pivoted within a carriage mounted so as to rotate about a second axis that is perpendicular to the first one. The escape wheel of the regulating organ meshes with a drive wheel integral with the first axis and forming the output of a first epicycloidal gear train (called "differential" in said document) with three conical planetary wheels, and thus with two conical gears. The inputs of this differential are a corrective first kinematical chain and a driving second kinematical chain, itself attached to the output of a second epicycloidal gear train (called once more "differential" in said document) that has as its input the barrel wheel and a second corrective kinematical chain meshing with a wheel integral with the carriage. In this second differential, three more conical planetary wheels and thus two more conical gears are used, making a total of at least six conical gears for the wheelwork of the mechanism. It should also be noted that all wheels of the first corrective kinematical chain are pivoted on the platform, either concentrically to its axis of rotation or about a fixed axis that is parallel to the latter. In similar fashion, all the wheels of the second corrective kinematical chain are pivoted on the carriage, either concentrically to its axis of rotation or about a fixed axis that is parallel to this axis.

According to document EP 1 615 085, this mechanism effectively allows the regulating organ to be kept in a horizontal plane whatever the position of the watch, solely by the effect of gravity.

However, a major disadvantage of this mechanism consists in the complexity of its wheelwork containing two corrective kinematical chains and a large number of conical gears, particularly so in its epicycloidal gear trains, which causes important power losses and hence necessitates a heavy counterpoise and a large power reserve. Moreover, since all the wheels of these corrective kinematical chains are pivoted on the platform or on the carriage, the weight of this unbalanced system is large, which detracts from the stabilizing effect of the counterpoise.

SUMMARY OF THE INVENTION

The present invention aims at realizing a mechanism that avoids rate variations due to the effect of gravitation in a regulating organ of the sprung balance type, and more particularly of a timepiece, which allows said sprung balance to rotate about an axis and to be maintained within a reference plane, preferably horizontal when said rotation is about two orthogonal axes, merely under the effect of terrestrial gravity, a mechanism that is simple, preferably free of energy-consuming conical gears or comprising a mere minimum of such gears, and thus admitting a reduction of weight of the counterpoise, of space requirements for the mechanism, and of power reserve.

Object of the present invention is a mechanism avoiding rate variations caused by the effect of gravitation in a sprung balance regulating organ and a timepiece provided with such a device that overcomes the disadvantages of existing devices named above.

This mechanism avoiding the rate variations caused by the effect of gravitation on a regulating organ in a clockwork movement of a timepiece where the regulating organ comprises a sprung balance and an escape wheel mounted on a platform, said platform comprising a counterweight and being mounted so as to freely rotate about a first axis (A-A) relative to a plate of the movement so that this platform will rotate about said first axis (A-A) under the effect of terrestrial gravitation; is distinguished by the fact that the mechanism comprises a wheelwork including a driving kinematical chain linking the escape wheel to a barrel system of the timepiece, as well as a corrective kinematical chain compensating the movements and speed of the platform relative to a plate of the clockwork movement so that these movements of the platform will not perturb the chronometry of the timepiece, this wheelwork including one or several epicycloidal gear trains and each of said trains in said wheelwork containing mobile parts meshing exclusively in straight fashion.

The invention refers as well to a mechanism avoiding the rate variations caused by the effect of gravitation in a regulating organ of a clockwork movement of a timepiece where the regulating organ comprises a sprung balance and an escape wheel mounted on a platform, said platform comprising a counterweight and being mounted so as to freely rotate about at least a first axis relative to a plate of the movement so that this platform will rotate about said first axis under the effect of terrestrial gravitation; that is distinguished by the fact that the escape wheel is linked on the one hand to a barrel system of the timepiece via a driving kinematical chain, and on the other hand to the plate of the movement by a corrective kinematical chain.

The invention refers as well to a mechanism avoiding the rate variations caused by the effect of gravitation on a regulating organ of a clockwork movement of a timepiece where the regulating organ comprises a sprung balance and an escape wheel mounted on a platform, said platform comprising a counterweight and being mounted so as to freely rotate about at least a first axis relative to a plate of the movement so that this platform will rotate about said first axis under the effect of terrestrial gravitation; said mechanism comprising a driving kinematical chain linking the escape wheel to a barrel system of the timepiece, as well as a corrective kinematical chain compensating the movements and speed of the platform relative to a plate of the clockwork movement so that these movements of the platform will not perturb the chronometry of the timepiece, where the fourth wheel of the wheelwork driving the clockwork movement is placed onto the platform.

Additional characteristics of this mechanism are specified in the depending claims.

Another object of the invention is a timepiece provided with such a mechanism.

BRIEF DESCRIPTION OF THE DRAWINGS

The annexed drawing illustrates schematically and by way of example various embodiments of the mechanism according to the invention.

DETAILED DESCRIPTION OF THE INVENTION

Figure 1:
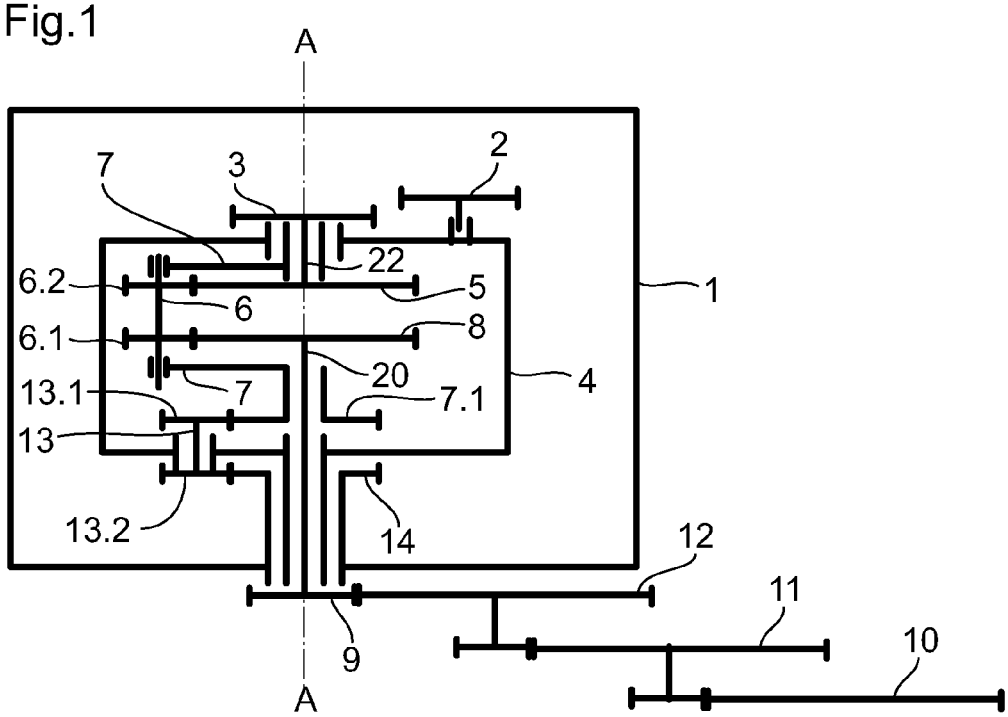
FIG. 1 schematically illustrates an embodiment of the mechanism according to the invention that yields a stabilization of the balance about an axis parallel to the axis of this balance.

Object of the present invention is a mechanism avoiding the rate variations of a regulating organ of the sprung balance type in a timepiece such as a wristwatch or pocket watch that arise on account of the effect of terrestrial gravitation due to changes in spatial orientation of the regulating organ. To this effect the mechanism according to the invention comprises means that allow the regulating organ to remain in a stable spatial position despite the movements imposed by the wearer of the timepiece while avoiding perturbations of the time display. Preferably the stable spatial position of the regulating organ is a position where the balance remains in a horizontal or vertical reference plane whatever the position of the watch.

The principle underlying the mechanism according to the invention that avoids rate variations consists in mounting the regulating organ, that is, generally the sprung balance, the pallets, and the escape wheel, onto a platform that is able to rotate about one or two axes orthogonal to the plate of the watch movement, this platform being subject to the effects of a counterweight that will thus allow said platform to be maintained under the effects of terrestrial gravity in a fixed plane of reference (horizontal, vertical, or possibly inclined) whatever the position of the watch, and hence of its movement.

A wheelwork of this mechanism comprises a driving kinematical chain linking the escape wheel to the barrel system, as well as a corrective kinematical chain that compensates the movements and speed of the platform relative to the plate so that these movements of the platform will not perturb the chronometry of the timepiece. As will be seen further on, it is possible in particular owing to this corrective kinematical chain, when the platform starts rotating under the effects of its counterweight, to completely cancel the effects of the displacements and speed of the platform on the principal driving kinematical chain. Thus, the functioning of escapement and time display of the clockwork movement are not perturbed despite the fact that the platform starts rotating in order to maintain the balance within a plane of reference, such as horizontal.

Preferably, in certain embodiments the wheelwork and notably the driving and corrective kinematical chains are particular in that they only consist of epicycloidal gear trains with wheels meshing straight. The wheelwork thus excludes any epicycloidal train having conical gears with a highly unfavorable efficiency. Moreover, even in embodiments where the wheelwork includes conical gears elsewhere in such driving and corrective kinematical chains, the latter are always present in smaller number relative to comparable wheelwork systems of the prior art.

It will also be seen further on that in another embodiment, another important particularity of the mechanism according to the invention resides in the fact that a mobile part in the principal driving kinematical chain be mounted into a planetary wheel holder rotating about two coaxial drive shafts that sit or do not sit on a mobile assembly comprising the platform holding the balance as well as a carriage pivoted on the plate of the movement on which said platform is pivoted.

A mechanism is thus realized that avoids the rate variations of the regulating organ while consuming little energy, so that the weight of the platform's counterweight can be diminished while the power reserve of the clockwork movement is not reduced significantly.

According to another preferred embodiment of the invention, the corrective kinematical chain links the escape wheel to the plate, and includes at least one mobile pivoted on the plate, which advantageously reduces the effect of the weight exerted by this corrective chain on the unbalanced platform. According to yet another preferred embodiment of the invention, the fourth wheel sits on the platform, which strongly minimizes the influence that the rotation of the platform will have on the couple transmitted to the escapement by the principal driving kinematical chain.

In the following, several embodiments and variants of the mechanism avoiding the rate variations of the regulating organ in a clockwork movement will be described as non-limiting examples.

The first embodiment of the mechanism avoiding the rate variations of a regulating organ in a clockwork movement is illustrated in FIG. 1. One has to do here with a simplified mechanism, in that the platform holding the regulating organ is mounted onto the plate of the movement, so as to freely rotate about only one axis of rotation A-A that is perpendicular to the plane of plate 1 of the clockwork movement.

The regulating organ including a balance 2, pallets (not illustrated), and an escape wheel 3 is held by a platform 4 pivoted concentrically to axis A-A on plate 1 of the movement. As illustrated in the figures, the axis of rotation A-A of platform 4 comprises a first drive shaft 20 and a second drive shaft 22, the platform being so designed that these two drive shafts rotate about the same axis A-A. In this embodiment the axis of balance 2 is parallel to this axis of rotation A-A of platform 4.

The escape wheel 3 pivoted coaxially to the axis A-A on platform 4 is integral with a driving wheel or second drive wheel 5 linked to the escape wheel via the second drive shaft 22. This second drive wheel 5 meshes with the first wheel 6.2 of planetary mobile 6 freely pivoted in a planetary wheel holder 7 which in turn is pivoted on platform 4 and rotated about axis A-A by a wheel 7.1 of the planetary wheel holder. In this manner the planetary wheel holder 7 effectively constitutes a carriage rotating concentrically with platform 4, and within which the planetary mobile 6 is mounted idling. As will be seen herein below, the speed of rotation of this planetary wheel holder 7 is a function of the speed of rotation of platform 4 about axis A-A.

The second wheel 6.1 of the planetary mobile 6 that is integral and coaxial with the first wheel 6.2 of this planetary mobile 6 meshes with a first drive wheel 8 integral with the first drive shaft 20 pivoted on plate 1 of the movement. Wheel 8 and shaft 20 are integral with the fourth wheel 9 of the going train of the clockwork movement. In conventional manner, this fourth wheel 9 is kinematically linked to barrel system 10 of the clockwork movement via the third wheel 12 and the center wheel 11, all of them pivoted on plate 1 of the clockwork movement about axes parallel to axis A-A.

Thus, escape wheel 3 is linked to barrel 10 via a principal driving kinematical chain including a train of straight epicycloidal gears constituted by driving wheel 5, the first 6.1 and second 6.2 wheels of planetary mobile 6, the first drive wheel 8, the fourth wheel 9; the third wheel 12, the center wheel 11, and the barrel 10. This principal driving kinematical chain does not include any conical setting wheel, and thus offers a very good efficiency, for instance an efficiency that is essentially the same as that of the going train of a classical mechanical watch.

When a displacement of the timepiece that includes this mechanism produces a rotation of platform 4 about axis A-A while a corrective kinematical chain is absent, then the wheels of the principal driving kinematical chain are set in rotation causing perturbations in the time display and particularly in the escapement.

To cancel the effects of these perturbations, a mobile of the principal driving kinematical chain—here mobile 6—is freely mounted into the planetary wheel holder 7, the latter forming part of a corrective kinematical chain further including wheel 7.1 of the planetary wheel holder, idle mobile 13 freely pivoted on platform 4 about an axis parallel to axis A-A, and a fixed wheel 14 concentric to the axis A-A, and integral with plate 1 of the movement. The idle mobile 13 includes a first wheel 13.1 meshing with wheel 7.1 of the planetary wheel holder, and a second wheel 13.2 (integral and coaxial with wheel 13.1) meshing with the fixed wheel 14.

Thus, by virtue of the corrective kinematical chain comprising fixed wheel 14, idle mobile 13, wheel 7.1 of the planetary wheel holder, as well as the planetary wheel holder 7 holding the planetary mobile 6, when platform 4 starts rotating, the planetary wheel holder 7 is set in rotation with a speed $V^7$ that depends on the speed $V^4$ of platform 4 (these speeds are relative to a fixed reference). This relation depends on the gear ratio between wheels 14, 13.2, 13.1, and 7.1, and in particular:

$$V^7 = (1 - k_1) \cdot V^4 \text{ where } k_1 = \frac{R_{14} \cdot R_{13.1}}{R_{13.2} \cdot R_{7.1}},$$

$R_x$ being the number of teeth of wheel X.

By judicious selection of the different gear ratios, mobile 6 can be set in rotation about axis A-A in such a way that the effect of the displacements and speed of platform 4 on the principal driving kinematical chain is canceled. More particularly, if $V^9$ is the speed of the third wheel at the exit of the platform, and $V^u$ the useful speed transmitted to the escapement (these speeds again being relative to a fixed reference), then one obtains the following relation:

$$V^9 = \frac{1}{k_2}[V^u + (k_1 + k_2 - k_1 \cdot k_2) \cdot V^4] \text{ where } k_2 = \frac{R_8 \cdot R_{6.2}}{R_{6.1} \cdot R_5}.$$

It will suffice to cancel the term $(k_1+k_2-k_1 \cdot k_2)$ in order to make $V^9$ independent of $V^4$. The relation that must be satisfied then becomes:

$$(k_1+k_2-k_1 \cdot k_2)=0 \text{ with } k_1 \neq 1 \text{ and } k_2 \neq 1.$$

It can be seen that the corrective kinematical chain includes a train of straight epicycloidal gears but excludes any conical gear that is a large energy consumer.

Thus, the wheelwork of this mechanism only includes trains of straight epicycloidal gears, and hence is particularly efficient, so that a better yield can be obtained and the weight of the counterweight of platform 4, hence also its space requirements can be reduced, and accordingly, the power reserve of the clockwork movement need not be diminished.

The counterweight of platform 4 may consist of the regulating organ itself, i.e., sprung balance and escapement, since it may be mounted onto platform 4 with an offset relative to the axis of rotation A-A of the platform. One thus avoids making the clockwork movement heavier. It is understood that in variants, a weight or mass could be fixed to platform 4 so as to be eccentric relative to axis A-A, in order to raise the platform's counterweight.

Figure 1A:
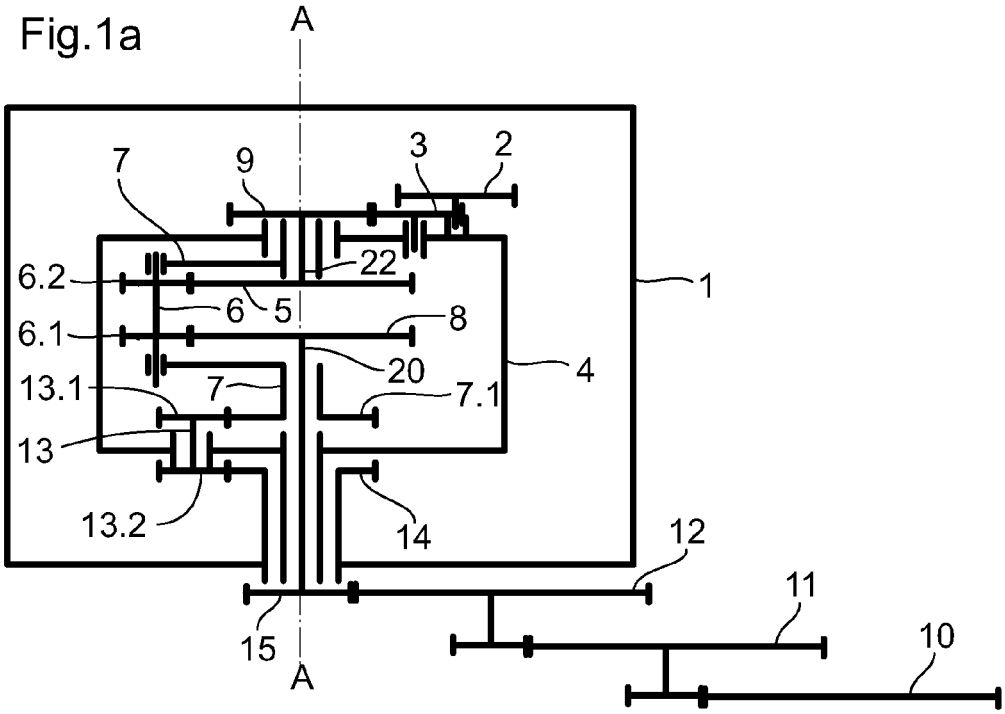
FIG. 1*a* is a scheme of a variant of the mechanism illustrated in FIG. 1.

FIG. 1*a* illustrates a variant of the mechanism described while referring to FIG. 1. In this variant the fourth wheel 9 of the movement's wheelwork sits on platform 4 and meshes with the pinion of escape wheel 3. Thus, it is no longer the axis of escape wheel 3 that falls together with the axis A-A of rotation of platform 4 but the axis of the fourth wheel 9, while balance 2 and escape wheel 3 are pivoted on platform 4, parallel to axis A-A.

In this embodiment it is the fourth wheel 9 that is integral and concentric with the driving wheel 5 via the second drive shaft 22. Via the first drive shaft 20, the first drive wheel 8 is integral with a third drive wheel 15 that meshes with the third wheel 12.

By placing a wheel of the conventional going train, here the fourth wheel 9, onto platform 4 one largely minimizes the influence that may be exerted by the rotation of platform 4 onto the couple that is transmitted to the escapement by the principal driving kinematical chain. It will of course be possible to place a second or even a third wheel of the conventional going train onto platform 4; the larger the number of wheels being placed, the smaller will be the effect of rotation of platform 4 onto the couple transmitted from barrel 10 to escape wheel 3. It will be noticed that in this embodiment the speed $V^u$ indicated above will become the useful speed transmitted to the first wheel sitting on platform 4, that is, the fourth wheel 9 in FIG. 1*a*.

Figure 2:
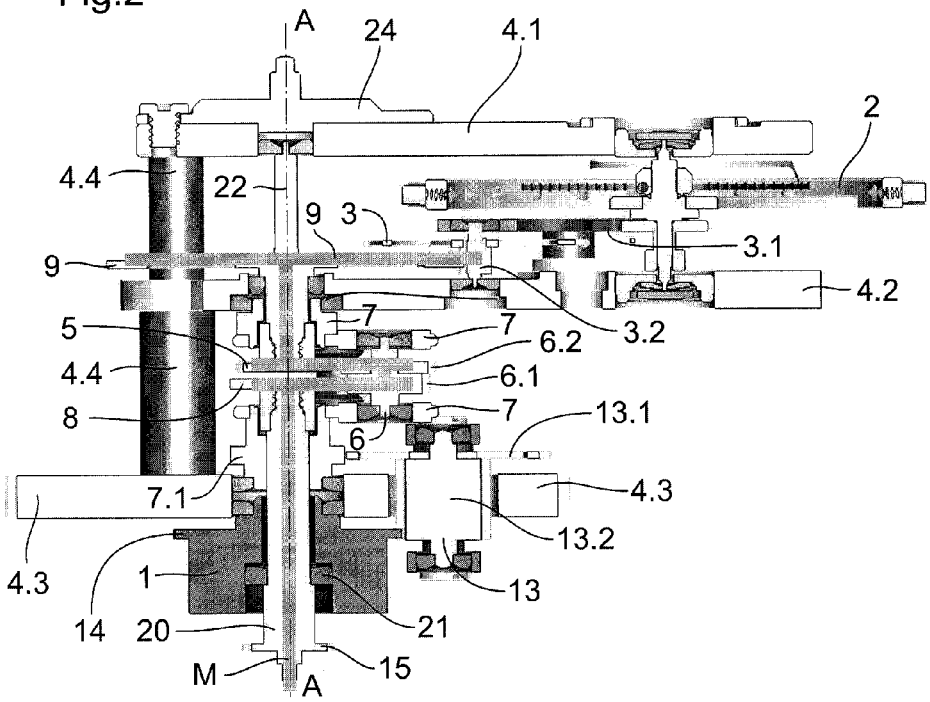
FIG. 2 illustrates a design corresponding to the scheme of FIG. 1*a* that displays the principal drive chain.
Figure 3:
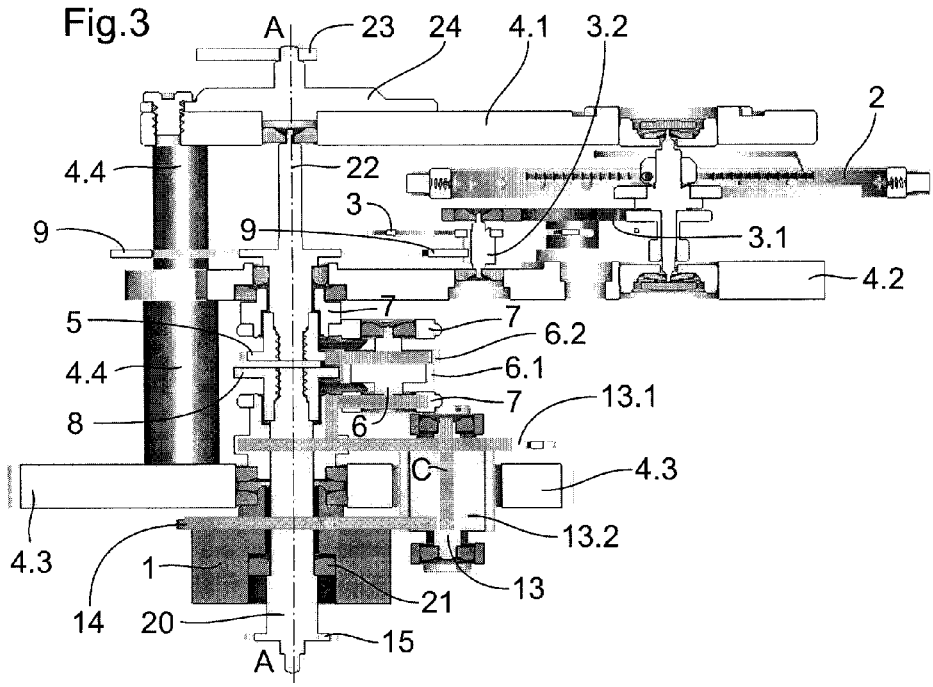
FIG. 3 illustrates the design illustrated in FIG. 2 that displays the corrective chain.
Figure 4:
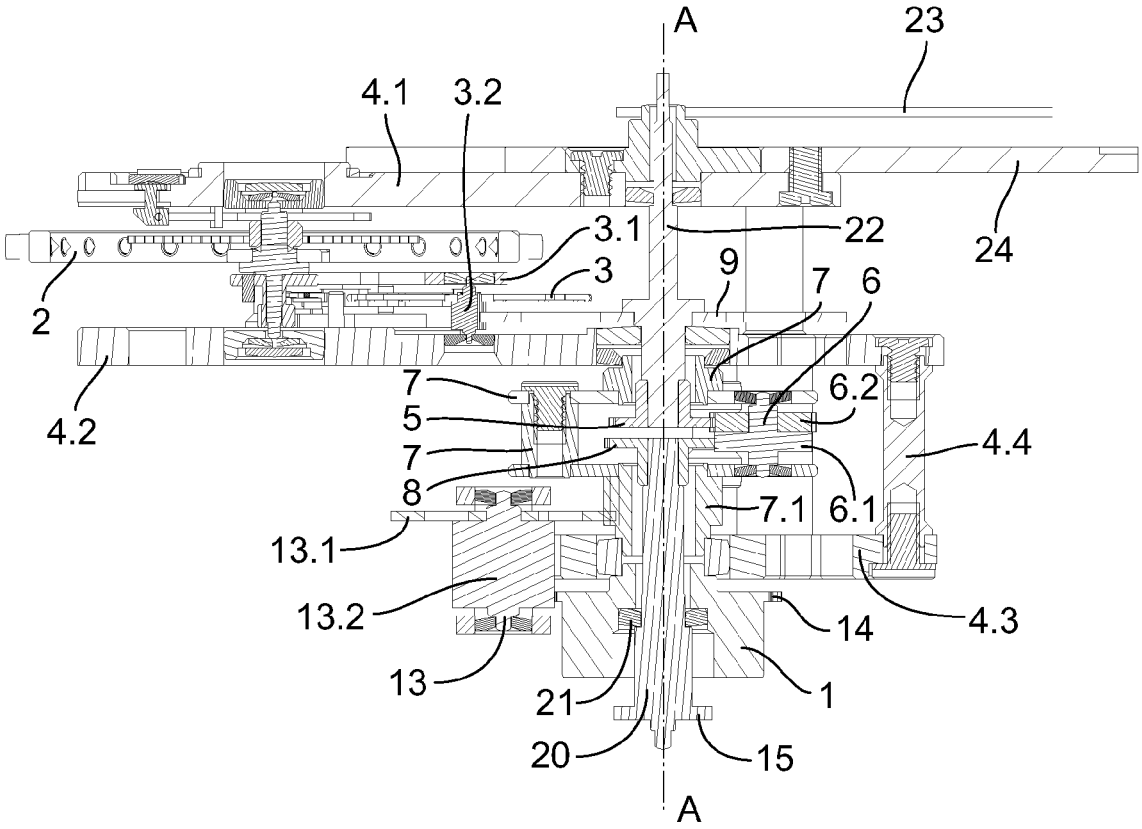
FIG. 4 is a sectioned view of the design illustrated in FIGS. 2 and 3.

FIGS. 2, 3, and 4 illustrate by way of example a practical realization of the embodiment of the mechanism described while referring to the scheme of FIG. 1*a*, that is, for a stabilization of platform 4 holding the regulating organ 2, 3 and the fourth wheel 9, about a single axis A-A.

Platform 4 consists of an upper bridge 4.1, an intermediate bridge 4.2 holding an escapement bridge 3.1, and a lower bridge 4.3 pivoted on plate 1 concentrically to axis A-A.

The three bridges 4.1, 4.2, and 4.3 of platform 4 are made integral by pillars 4.4, so that it is guaranteed that all these elements of the platform will freely rotate together relative to the plate.

The third drive wheel 15 is integral with the lower end of the first drive shaft 20 that is pivoted in a bearing 21 in plate 1, the shaft 20 freely rotating relative to the plate as indicated above. This first drive shaft 20 holds the first drive wheel 8 on its upper end.

The fixed wheel 14 of plate 1 meshes with the second wheel 13.2 of idle mobile 13, while the first wheel 13.1 of this idle mobile that are pivoted on the lower bridge 4.3 meshes with the wheel 7.1 of the planetary wheel holder of the lower hub of planetary wheel holder 7 pivoted in the lower bridge 4.3 concentrically to axis A-A about the first drive shaft 20. Planetary mobile 6 is pivoted idle on planetary wheel holder 7, the second wheel 6.1 of planetary mobile 6 meshes with the first drive wheel 8 while the first wheel 6.2 of planetary mobile 6 meshes with the driving wheel or second drive wheel 5 that is integral with the lower end of the second drive shaft 22 pivoted on the intermediate bridge 4.2 of platform 4. This second drive shaft 22 holds the fourth wheel 9 that meshes with the pinion 3.2 of escape wheel 3. In this FIG. 2, the path of the principal driving kinematical chain M linking the third drive wheel 15 (that is connected with the barrel by the going train) to the escape wheel 3 via the planetary mobile 6 and the fourth wheel 9 has been marked out.

In FIG. 3, the path of the corrective kinematical chain C linking the planetary wheel holder 7 to plate 1 via the wheel 7.1 of the planetary wheel holder, the idle mobile 13, and the fixed wheel 14 has been marked out.

FIG. 4 is a sectioned view of the mechanism illustrated in FIGS. 1*a*, 2, and 3.

The second drive shaft 22 has been extended beyond the intermediate bridge 4.2 of platform 4, and is likewise pivoted in the upper bridge 4.1 of this platform 4. In this variant of the first embodiment of the mechanism where the fourth wheel 9 has been placed onto platform 4, the free upper end of this second drive shaft 22 has been extended beyond the upper bridge 4.1 and holds a seconds hand 23 cooperating with a seconds dial 24 held by the upper side of the upper bridge 4.1 of platform 4.

In this embodiment the seconds dial 24 rotates about axis A-A following the displacements of platform 4. The seconds-hand 23 also rotates following the displacements of the platform, but in addition is set in rotation relative to dial 24 by the principal driving kinematical chain. At any given point in time or when the watch movement is stopped, this seconds-hand 23 then will remain immobile relative to the seconds dial 24 while the dial itself rotates about axis A-A.

The display of hours and minutes occurs in classical fashion starting from a wheel of the going train of the clockwork movement, generally the center wheel 11 or the third wheel 12, via a dial train that drives the hours hand and minutes hand, both cooperating with a dial fixed relative to the plate of the clockwork movement.

The display of the seconds in this mechanism that has just been described is original and playful, inasmuch as it rotates about itself with all movements of the platform, that is, any time the orientation of the watch in space is changing owing to movements made by the wearer of this watch.

By virtue of this mechanism that avoids the rate variations of a regulating organ, it will be possible via the effect of gravity acting upon the counterweight of platform 4, to maintain the balance within a fixed reference plane, preferably horizontal or vertical but possibly even inclined, whatever the spatial orientation of plate 1 about axis A-A. The movements about this axis A-A imparted by the wearer of the watch will then no longer influence the rate of the regulating organ, which always works under the same conditions. Having just one corrective chain will suffice to suppress the influence of the displacements and speed of platform 4 on escape wheel 3 and thus on the regulating organ, as well as on the time display, since they are integrally compensated. In the embodiment where the fourth wheel 9 is placed onto the platform, the parasitic couples that may come from movements of platform 4 and act upon the escape wheel are reduced to a negligible value, or even to zero.

Moreover, we have already seen that according to this embodiment, the driving and corrective kinematical chains comprise trains of straight epicycloidal gears exclusively, which have a very high efficiency so that the movement's power reserve need not be reduced and the weight and space requirements of the counterweight of platform 4 can be reduced to a minimum.

According to yet another variant (not illustrated) of the first embodiment, it will be possible instead of placing the fourth wheel 9 onto platform 4, to install a constant-force escapement on the platform in order to avoid the influence that might be exerted by rotation of the platform onto the couple transmitted to the escapement.

Figure 5:
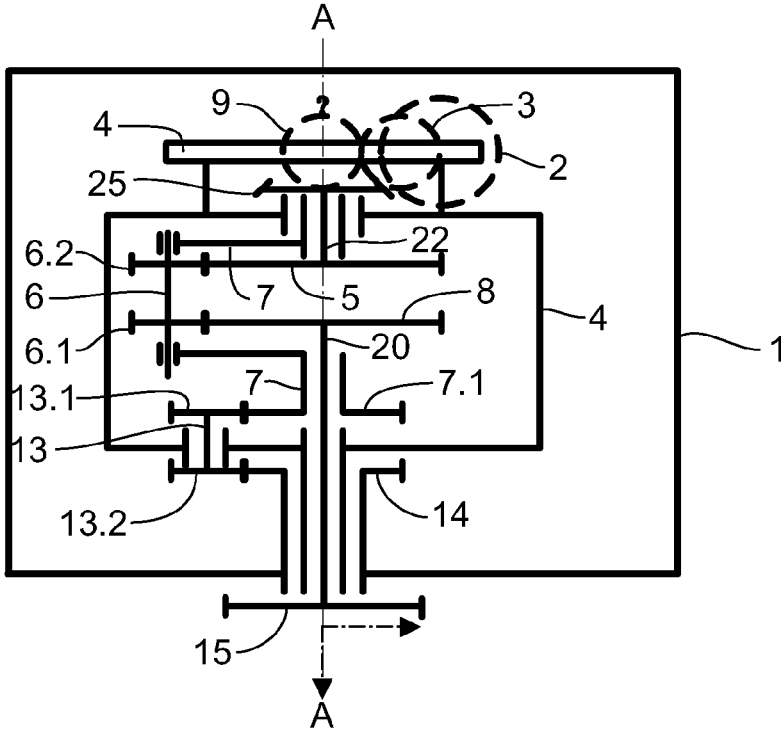
FIG. 5 schematically illustrates an embodiment of the mechanism according to the invention yielding a stabilization of the balance about an axis orthogonal to the axis of the balance.

FIG. 5 illustrates an embodiment of the mechanism avoiding the rate variations of the regulating organ in a clockwork movement where platform 4 is stabilized about an axis of rotation A-A orthogonal to the axis of balance 2. In this embodiment the axis of balance 2, the axis of the escape wheel 3, and the axis of the fourth wheel 9 that is placed onto the platform are all perpendicular to the axis of rotation A-A of platform 4. In this embodiment, the correction mechanism in addition to the elements already described while referring to FIGS. 1 to 4, includes a conical setting wheel 25 integral with the driving wheel or second drive wheel 5 that meshes with the fourth wheel 9. Otherwise the mechanism is identical with that of the first embodiment in its variant described in FIGS. 1 to 4. In this embodiment axis A-A about which the platform rotates may for example be the axis 3 o'clock-9 o'clock of the watch.

Figure 6:
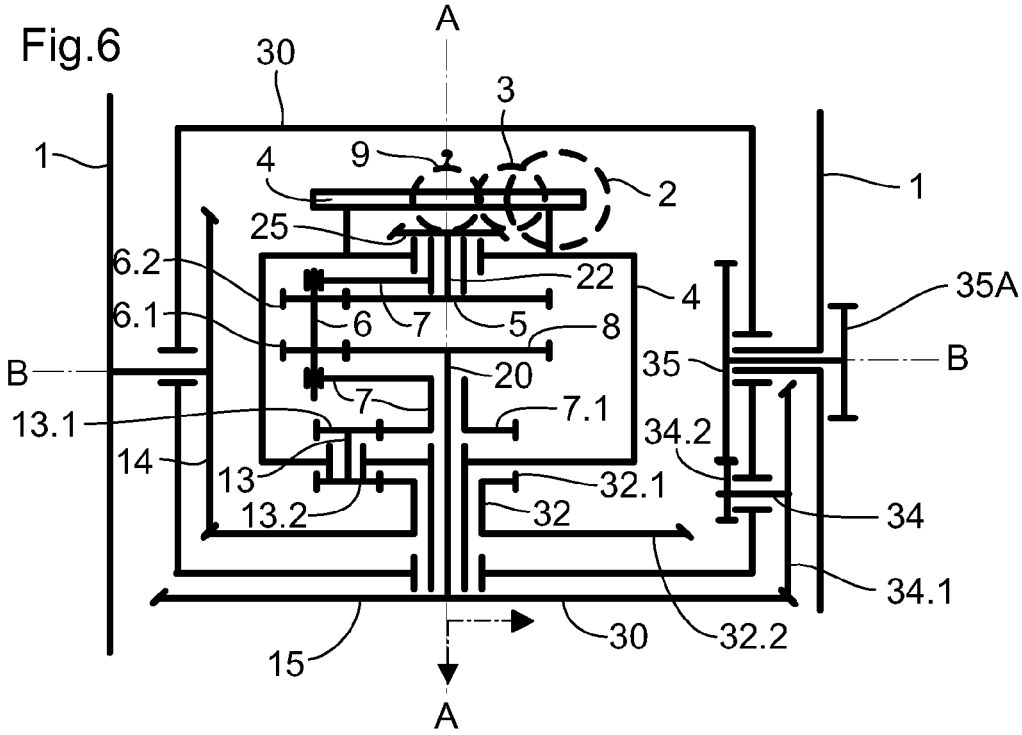
FIG. 6 schematically illustrates an embodiment of the mechanism according to the invention yielding a stabilization of the balance about two axes orthogonal to the axis of the balance.
Figure 7:
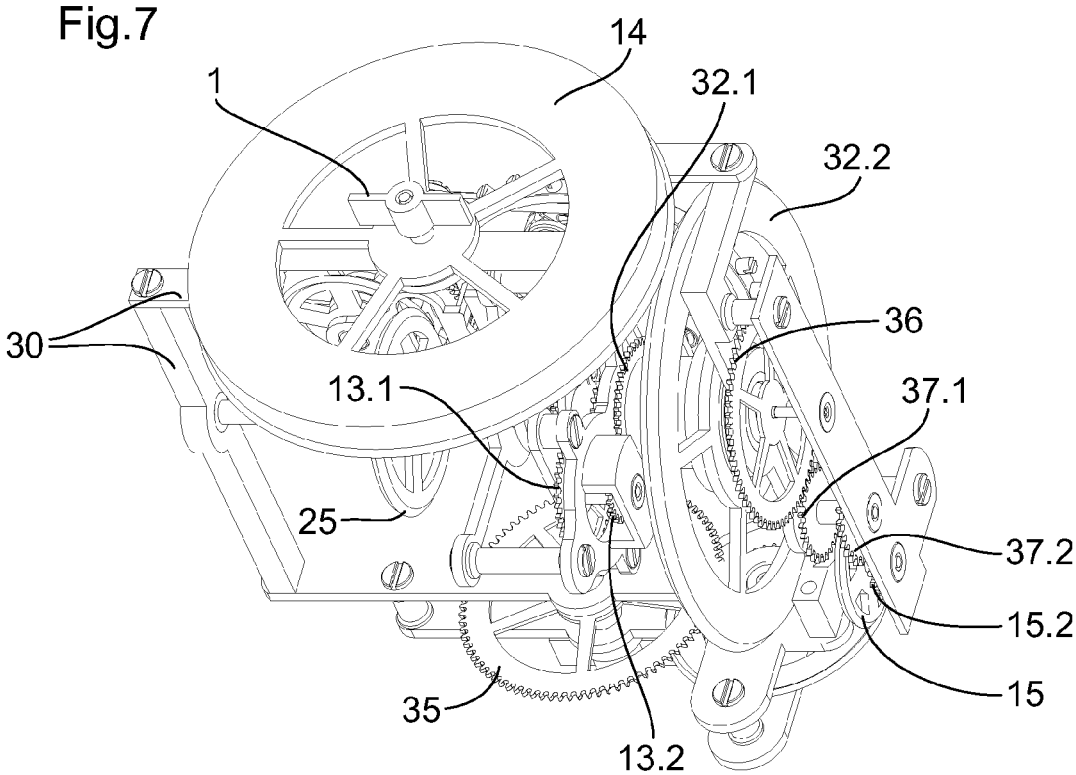
FIG. 7 is a perspective view of a design corresponding to the scheme of FIG. 6.
Figure 8:
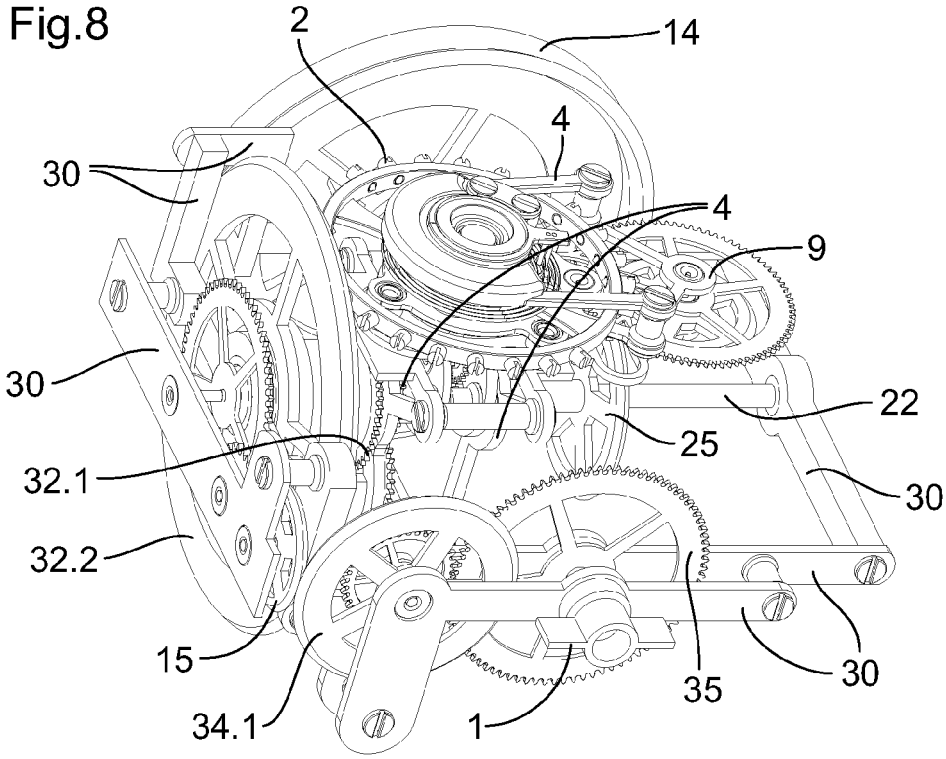
FIG. 8 is another perspective of the design illustrated in FIG. 7 that is seen under a different angle.
Figure 9:
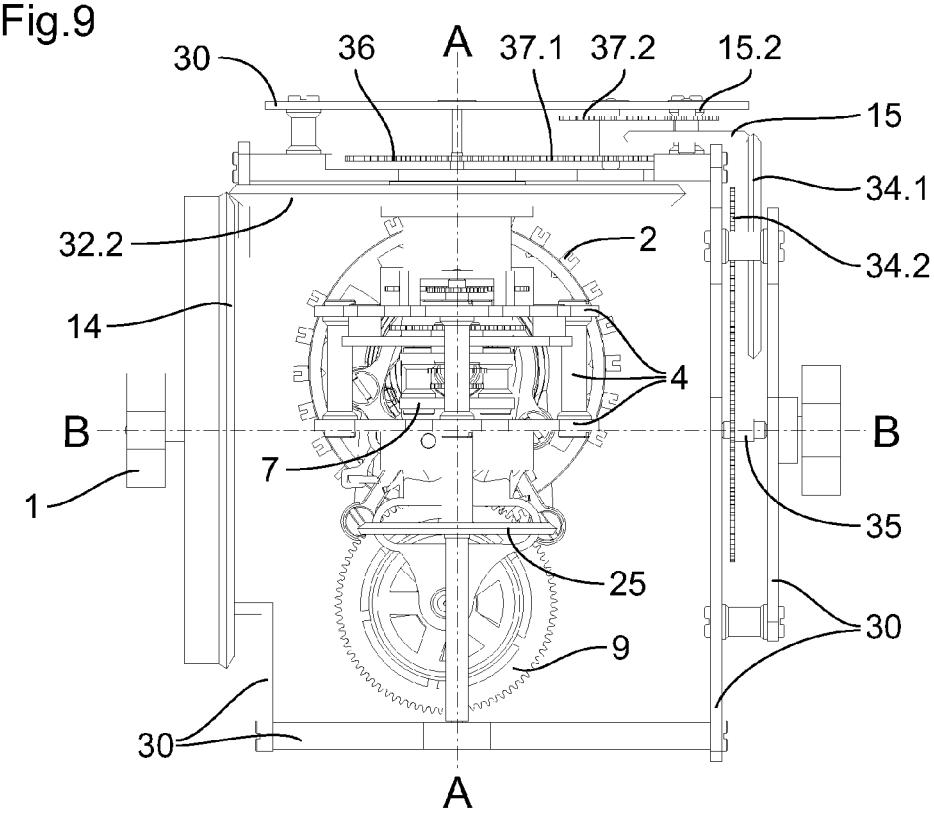
FIG. 9 is a lateral view of the design illustrated in FIG. 7 or FIG. 8.
Figure 10:
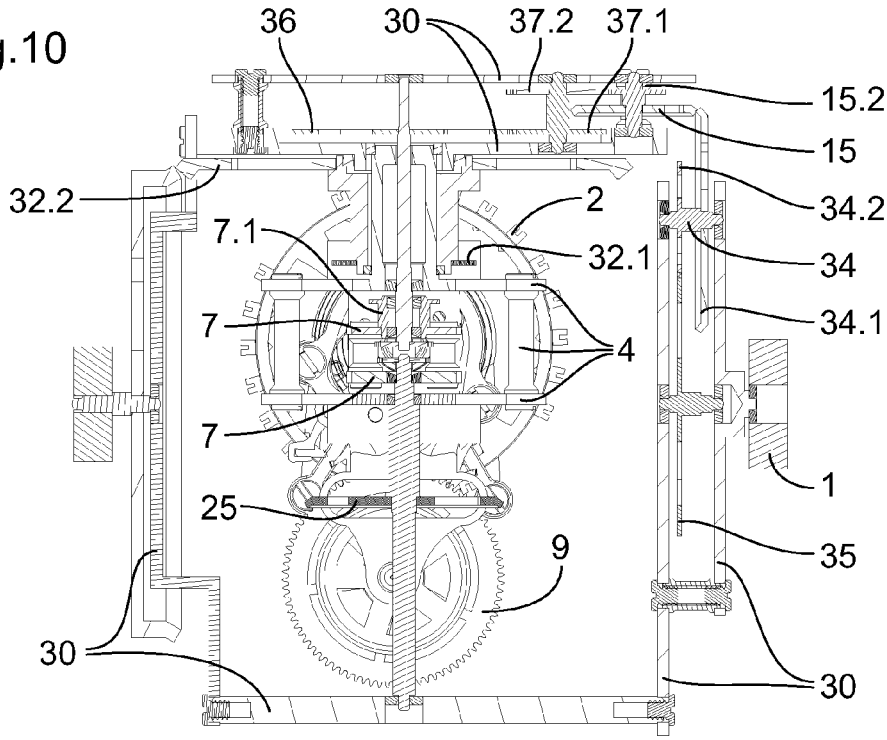
FIG. 10 is a section of the design illustrated in FIG. 9 that is along a plane containing axes A-A and B-B.
Figure 11:
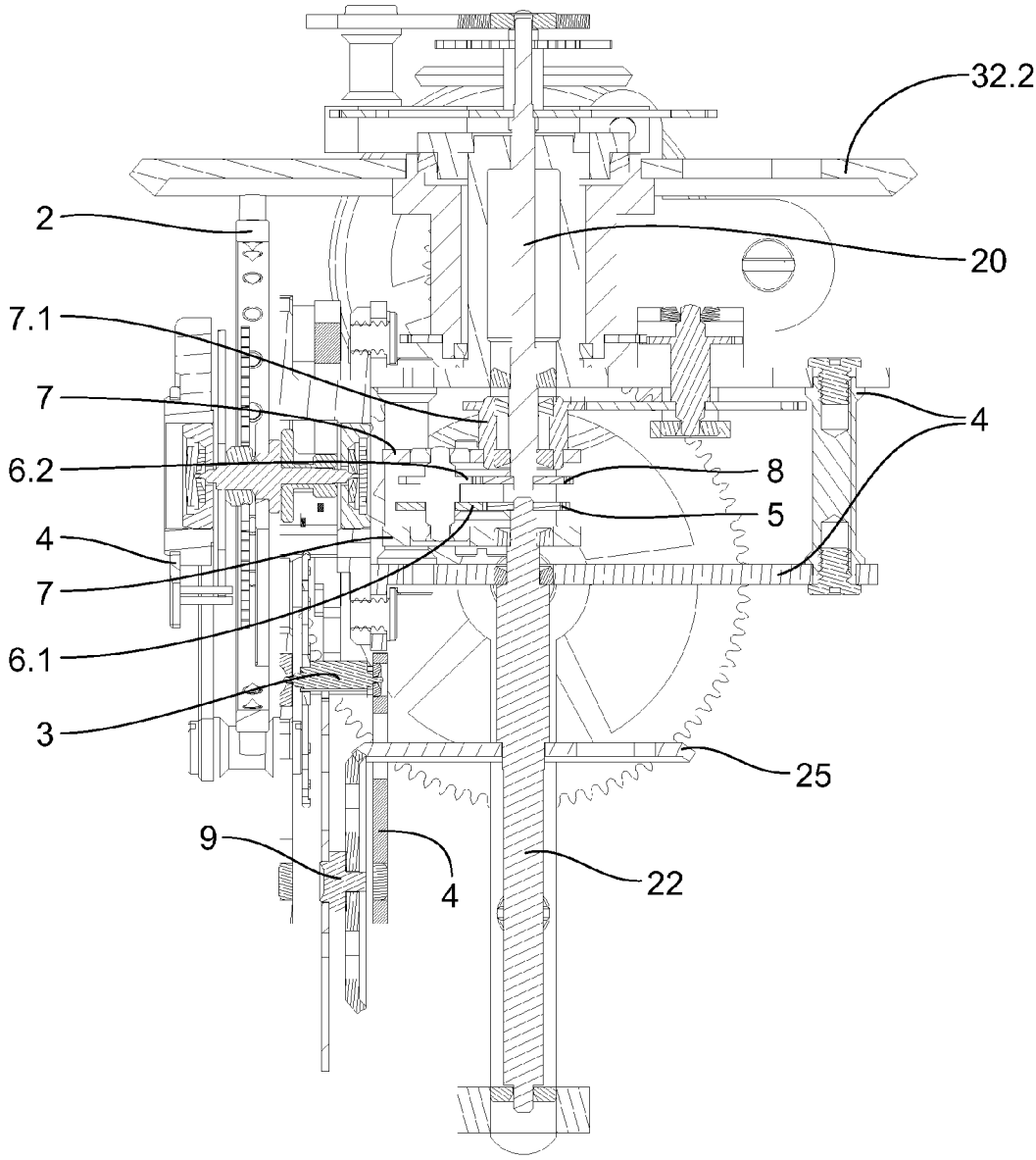
FIG. 11 is a section of the design illustrated in FIG. 9 that is along a plane containing axis A-A and perpendicular to axis B-B.

The embodiment of the mechanism avoiding the rate variations of a regulating organ in a clockwork movement that is schematically illustrated in FIG. 6 allows a stabilization of platform 4 holding the balance 2, to occur about two axes of rotation A-A and B-B that are mutually orthogonal and orthogonal to the axis of rotation of balance 2. With such a mechanism, platform 4 holding the regulating organ of the watch can be maintained within a fixed plane of reference whatever the orientation of plate 1 of the watch movement in space, and no longer merely relative to a single axis of displacement. A realization or practical design of such an embodiment is illustrated by way of example in FIGS. 7 to 10. In these figures, the mechanism that is represented differs from that schematically illustrated in FIG. 6 by the addition of wheels 36; 37.1; 37.2; and 15.2 in order to reduce the space requirements of the third drive wheel 15.

This mechanism includes a carriage 30 pivoted on plate 1 about a second axis of rotation B-B. Platform 4 of the FIG. 5 described above is mounted onto this carriage 30 so that it may rotate about the first axis of rotation A-A perpendicular to the second axis of rotation B-B of carriage 30.

As in the embodiment described while referring to FIG. 5, platform 4 holds balance 2, escape wheel 3, and fourth wheel 9 having their axes mutually parallel, and orthogonal relative to the first A-A and second B-B axes of rotation.

The fourth wheel 9 meshes with the conical setting wheel 25 that is integral with the driving wheel or second drive wheel 5 pivoted on platform 4 concentrically to the first axis of rotation A-A about which platform 4 rotates. Still as described above, this driving wheel 5 meshes with the first wheel 6.2 of planetary mobile 6 whose carriage, the planetary wheel holder 7, pivots about the first axis of rotation A-A on platform 4. The second wheel 6.1 of the planetary mobile meshes with the first drive wheel 8 pivoted concentrically to the first axis of rotation A-A on carriage 30, which in turn pivots about the second axis of rotation B-B on plate 1. This first drive wheel 8 is integral with the third drive wheel 15, both pivoted on carriage 30.

The planetary wheel holder 7 meshes via its wheel 7.1 of the planetary wheel holder, with the first wheel 13.1 of idle mobile 13 pivoted freely on platform 4, its second wheel 13.2 meshing with the first wheel 32.1 of corrector mobile 32 whose second wheel 32.2 has conical teeth. This corrector mobile 32 is pivoted on platform 4, more precisely about the first drive shaft 20, concentrically to its axis of rotation A-A on carriage 30. This corrector mobile 32 meshes via its second wheel 32.2 with the fixed wheel 14 that is integral with plate 1. Thus, in this embodiment the fixed wheel 14 has conical teeth.

The third drive wheel 15 also has conical teeth, and meshes with the first wheel 34.1 with conical teeth of second idle mobile 34 freely pivoted on carriage 30. The second wheel 34.2 of this second idle mobile 34 meshes with a fourth drive wheel 35 pivoted concentrically to the second axis of rotation B-B on carriage 30. This fourth drive wheel 35 is integral with a fifth drive wheel 35A kinematically linked to barrel 10 via a going train of the movement that may include a center wheel 11 and a third wheel 12, for example (for greater simplicity, the latter are not shown in FIG. 6).

In this embodiment, platform 4 that holds the regulating organ 2, 3 thus has two degrees of freedom: rotation about a first axis A-A and rotation about a second axis B-B orthogonal to the first axis A-A. Platform 4 having a counterweight constituted by the regulating organ 2, 3 or by an additional counterweight may thus be displaced as a function of whatever spatial orientation of plate 1 of the movement, to guarantee balance 2 being maintained in a fixed plane of reference, and thus to avoid all rate variations caused by gravity whatever the position of the watch or the movements imposed on it.

In this embodiment the principal driving kinematical chain comprises the fifth drive wheel 35A, the fourth drive wheel 35, the second idle mobile 34, the third drive wheel 15, the first drive wheel 8, the planetary mobile 6, the driving wheel (or second drive wheel) 5 and the conical setting wheel 25 as well as the fourth wheel 9 and the escape wheel 3.

The corrective kinematical chain comprises the fixed wheel 14, the corrector mobile 32, the first idle mobile 13, the wheel 7.1 of the planetary wheel holder, and the planetary wheel holder in this embodiment.

Here again, the wheelwork of this mechanism that more particularly includes these two chains, the driving and corrective kinematical chains, only includes trains of straight epicycloidal gears having a high efficiency. Moreover, although the wheelwork of the mechanism includes conical gears elsewhere in these driving and corrective kinematical chains, these gears always are present in a smaller number as compared to the prior art. For example, relative to the wheelwork of the mechanism described in document EP 1 615 085, that in FIG. 6 has considerably fewer linkages, and more particularly just half the number of conical gears used in the mechanism of EP 1 615 085. Moreover, according to the embodiment of FIG. 6, the correction of the displacements of carriage 30 and platform 4 are made with the aid of a single, continuous corrective kinematical chain.

Figure 12:
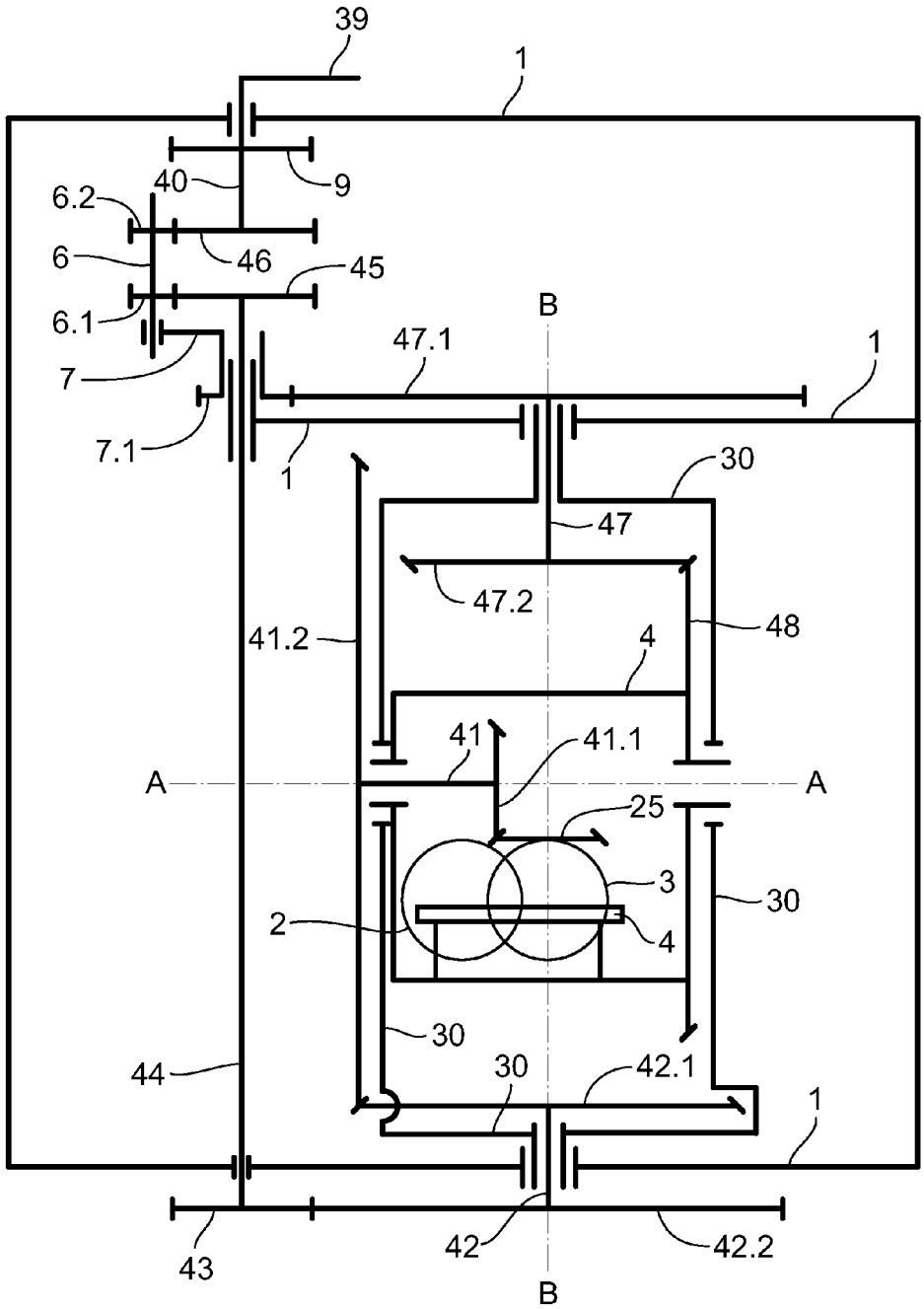
FIG. 12 schematically illustrates an embodiment of the mechanism according to the invention where the corrective chain is at least in part outside the carriage holding the balance.

FIG. 12 illustrates yet another embodiment of the mechanism having two axes of rotation where part of the corrective kinematical chain which notably includes mobile 6 and its planetary wheel holder 7 is situated outside platform 4 and carriage 30.

Platform 4 holding the regulating organ, sprung balance 2, and escape wheel 3 is pivoted on carriage 30, just as shown in FIG. 6, along a first axis of rotation A-A perpendicular to the axis of balance 2 and axis of escape wheel 3. Also, carriage 30 is pivoted on plate 1 along a second axis of rotation B-B perpendicular to the first axis of rotation A-A of platform 4 on carriage 30, and perpendicular to the axis of balance 2 and axis of escape wheel 3.

The fourth wheel 9 that is integral with a first drive shaft 40 is linked to the barrel by the usual going train of the watch movement. This first drive shaft 40 is pivoted on plate 1, and one of its ends holds a seconds hand 39 cooperating with a seconds-dial that is fixed relative to plate 1.

The escape wheel 3 meshes with the conical setting wheel 25 that meshes with the first wheel 41.1 of first driving mobile 41 pivoted on platform 4 coaxially with the axis of rotation A-A of platform 4. The second wheel 41.2 of this first driving mobile meshes with the first wheel 42.1 of second driving mobile 42 pivoted on carriage 30 and plate 1 coaxially to the axis of rotation B-B of this carriage 30. The second wheel 42.2 of this second driving mobile 42 meshes with a third drive wheel 43 integral with a second drive shaft 44 pivoted on plate 1 along a direction parallel to the axis of rotation B-B of carriage 30 on plate 1. This second drive shaft 44 is integral with a second drive wheel 45 meshing with the first planetary wheel 6.1 of planetary mobile 6 the second wheel 6.2 of which meshes with a first drive wheel 46 integral with a first drive shaft 40 and hence with the fourth wheel 9. These first and second drive shafts 40, 44 are coaxial.

According to this embodiment, planetary mobile 6 is freely pivoted in planetary wheel holder 7 concentrically to the first and second drive shafts 40, 44 on plate 1. The wheel 7.1 of the planetary wheel holder meshes with the first wheel 47.1 of corrector mobile 47 pivoted on plate 1 concentrically to the pivoting axis B-B of carriage 30 on plate 1, its second wheel 47.2 meshing with a corrector wheel 48 integral with platform 4 and concentric to axis of rotation A-A of this platform 4 on carriage 30.

In this embodiment, the principal driving kinematical chain includes the fourth wheel 9, the first drive shaft 40, the first drive wheel 46, planetary mobile 6, the second drive wheel 45, the second drive shaft 44, the third drive wheel 43, the second driving mobile 42, the first driving mobile 41, and the conical setting wheel 25 meshing with the escape wheel 3.

Even though this principal driving kinematical chain includes conical gears, all epicycloidal gear trains forming it are straight, and hence highly efficient. Moreover, the number of conical gears used elsewhere in the wheelwork is always smaller than in the prior art.

In this embodiment the corrective kinematical chain includes the corrector wheel 48, the corrector mobile 47, the wheel 7.1 of the planetary wheel holder, and the planetary wheel holder 7. This corrective chain again includes only a limited number of conical gears as well as epicycloidal trains meshing straight exclusively (thus excluding any epicycloidal train having a conical setting wheel); hence, this chain also has a relatively good efficiency.

In variants of this embodiment, the fourth wheel 9 may equally well be placed upon platform 4 to reduce or cancel the effects of movements of platform 4 on the couple transmitted to the regulating organ 2, 3.

Through this embodiment, it is seen that the weight and volume of platform 4 holding the regulating organ 2, 3 can be reduced by placing planetary mobile 6 and its planetary wheel holder 7 outside platform 4.

In all possible embodiments of this mechanism, it is necessary that the center of gravity of the mobile assembly constituted by platform 4 and carriage 30 be situated far from the axes of rotation A-A and B-B of this platform 4 relative to the plate, in order for this mobile assembly to offer a counterweight that will allow the regulating organ to be positioned within the plane of reference whatever the movements of plate 1.

It must be added that even in embodiments where platform 4 is articulated about two orthogonal axes A-A and B-B on the plate, the mechanism includes but a single corrective kinematical chain that is continuous.

It is obvious that in self-winding clockwork movements provided with such a corrective mechanism, the mobile assembly constituted by carriage 30 and/or platform 4 can be used as a winding mass for winding of the barrel through a kinematical winding chain linking platform 4 or carriage 30 to the barrel ratchet and including a direction inverter, e.g., of the Pellaton type. Carriage 30 and platform 4 may be unbalanced separately, or the group of mobile assembly, platform 4, and carriage 30 may be unbalanced.

The invention claimed is:

1. Mechanism avoiding the rate variations due to the effect of gravitation on a regulating organ in a clockwork movement of a timepiece where the regulating organ comprises a sprung balance and an escape wheel mounted onto a platform, said platform including a counterweight and being mounted so as to freely rotate about at least a first axis relative to a plate of the movement so that the platform may rotate about the first axis under the effect of terrestrial gravitation; wherein the mechanism comprises a wheelwork including a driving kinematical chain linking the escape wheel to a barrel system of the timepiece, as well as a corrective kinematical chain compensating the movements and speed of the platform relative to the plate, so that the movements of the platform do not perturb the chronometry of the timepiece, the corrective kinematical chain linking the escape wheel to the plate of the movement.

2. The mechanism according to claim 1, wherein the corrective kinematical chain comprises a first fixed wheel integral with the plate of the movement.

3. The mechanism according to claim 2, wherein the first fixed wheel is coaxial with the first axis of rotation of the platform.

4. The mechanism according to claim 3, wherein the corrective kinematical chain comprises planetary mobile freely pivoted on the platform and parallel to the first axis, said planetary mobile comprising a wheel meshing with the first fixed wheel.

5. The mechanism according to claim 2, wherein the platform is suspended within a carriage freely pivoted on the plate about a second axis of rotation that is orthogonal to the first axis of rotation.

6. The mechanism according to claim 5, wherein the corrective kinematical chain comprises a second fixed wheel integral with the plate of the movement, wherein the first fixed wheel is coaxial with the first axis of rotation and the second fixed wheel is coaxial with the second axis of rotation.

7. The mechanism according to claim 6, wherein the corrective kinematical chain comprises a corrector mobile integral with the platform and coaxial with the first axis of rotation.

8. The mechanism according to claim 7, wherein a wheel of the corrector mobile meshes with the second fixed wheel.

9. The mechanism according to claim 1, wherein the axis of the sprung balance is parallel to the first axis of rotation of the platform.

10. The mechanism according to claim 1, wherein the axis of the sprung balance is perpendicular to the first axis of rotation of the platform.

11. The mechanism according to claim 1, wherein a fourth wheel of the clockwork movement is placed upon the platform.

12. A mechanism avoiding the rate variations due to the effect of gravitation on a regulating organ in a clockwork movement of a timepiece where the regulating organ comprises a sprung balance and an escape wheel mounted onto a platform, said platform including a counterweight and being mounted so as to freely rotate about at least a first axis relative to a plate of the movement so that the platform may rotate about the first axis under the effect of terrestrial gravitation; wherein the mechanism comprises a wheelwork including a driving kinematical chain linking the escape wheel to a barrel system of the timepiece, as well as a corrective kinematical chain compensating the movements and speed of the platform relative to the plate, so that the movements of the platform do not perturb the chronometry of the timepiece, wherein a fourth wheel of the clockwork movement is placed upon the platform.

13. The mechanism according to claim 12 wherein the fourth wheel meshes with a pinion of the escape wheel, and wherein the sprung balance, the escape wheel, and the fourth wheel have axes that are parallel to one another.

14. The mechanism according to claim 12 wherein a third wheel of the clockwork movement is also placed upon the platform.

15. The mechanism according to claim 14 wherein a center wheel of the clockwork movement is also placed upon the platform.

16. The mechanism according to claim 12, wherein the axis of the sprung balance is parallel to the first axis of rotation of the platform.

17. The mechanism according to claim 12, wherein the axis of the sprung balance is perpendicular to the first axis of rotation of the platform.

18. The mechanism according to claim 12, wherein the platform is suspended within a carriage freely pivoted on the plate about a second axis of rotation that is orthogonal to the first axis of rotation.

19. The mechanism according to claim 12, wherein the axis of the fourth wheel coincides with a drive shaft, the free end of said shaft holding a seconds hand cooperating with a seconds dial integral with the platform and coaxial with the fourth wheel.

20. Mechanism avoiding the rate variations due to the effect of gravitation on a regulating organ in a clockwork movement of a timepiece where the regulating organ comprises a sprung balance and an escape wheel mounted onto a platform, said platform including a counterweight and being mounted so as to freely rotate about an axis relative to a plate of the movement so that the platform may rotate about the axis under the effect of terrestrial gravitation, the axis of rotation of the platform being parallel to the axis of the sprung balance; wherein the mechanism comprises a wheelwork including a driving kinematical chain linking the escape wheel to a barrel system of the timepiece, as well as a corrective kinematical chain compensating the movements and speed of the platform relative to the plate, so that the movements of the platform do not perturb the chronometry of the timepiece, the wheelwork comprising gears with straight toothing exclusively.

21. The mechanism according to claim 20, wherein the corrective kinematical chain comprises a fixed wheel integral with the plate of the movement and coaxial with the axis of rotation of the platform.

22. The mechanism according to claim 21, wherein the corrective kinematical chain comprises planetary mobile freely pivoted on the platform and parallel to the axis of the platform, said planetary mobile comprising a wheel meshing with the fixed wheel.

23. The mechanism according to claim 20, wherein a fourth wheel of the clockwork movement is placed upon the platform.

24. The mechanism according to claim 20, wherein a mobile assembly comprising the platform is used as a winding mass for an automatic winding system of the timepiece.

* * * * *